US011073368B2

(12) United States Patent
Forsell

(10) Patent No.: US 11,073,368 B2
(45) Date of Patent: Jul. 27, 2021

(54) CERAMIC BULLET TIP TO ASSIST BULLETS IN SHATTERING GLASS

(71) Applicant: Carl Edward Forsell, Norfolk, NE (US)

(72) Inventor: Carl Edward Forsell, Norfolk, NE (US)

( * ) Notice: Subject to any disclaimer, the term of this patent is extended or adjusted under 35 U.S.C. 154(b) by 0 days.

(21) Appl. No.: 15/784,572

(22) Filed: Oct. 16, 2017

(65) Prior Publication Data

US 2019/0113319 A1 Apr. 18, 2019

(51) Int. Cl.

| | |
|---|---|
| ***F42B 12/08*** | (2006.01) |
| ***F42B 12/74*** | (2006.01) |
| ***F42B 12/02*** | (2006.01) |
| ***F42B 30/02*** | (2006.01) |

(52) U.S. Cl.

CPC ..... *F42B 12/74* (2013.01); *F42B 12/02* (2013.01); *F42B 12/08* (2013.01); *F42B 30/02* (2013.01)

(58) Field of Classification Search

CPC ..... F42B 12/00; F42B 12/02; F42B 12/08; F42B 12/72; F42B 12/74; F42B 12/04; F42B 12/76; F42B 12/78; F42B 30/02

USPC ..... 102/501, 503, 519

See application file for complete search history.

(56) References Cited

U.S. PATENT DOCUMENTS

| | | | | |
|---|---|---|---|---|
| 4,742,774 | A * | 5/1988 | Flatau | F42B 10/34 102/439 |
| 4,939,996 | A * | 7/1990 | Dinkha | F42B 8/16 102/444 |
| 5,092,246 | A * | 3/1992 | Huerta | F42B 12/08 102/439 |
| 5,763,819 | A * | 6/1998 | Huffman | F42B 12/34 102/473 |
| 6,845,719 | B1 * | 1/2005 | Spencer | F42B 12/08 102/519 |
| H2230 | H * | 8/2009 | Nechitailo | 102/489 |
| 8,869,704 | B2 * | 10/2014 | Eches | F42B 12/08 102/521 |
| 9,964,385 | B1 * | 5/2018 | Genson | F42B 12/76 |
| 10,443,990 | B2 * | 10/2019 | Yadon | F42B 7/10 |
| 2004/0158969 | A1 * | 8/2004 | Ortmann | F42B 12/06 29/592 |
| 2020/0173761 | A1 * | 6/2020 | Vabnick | F42D 5/04 |
| 2020/0363176 | A1 * | 11/2020 | Pigott | F41G 11/001 |

FOREIGN PATENT DOCUMENTS

| | | | | |
|---|---|---|---|---|
| GB | 2582564 | A * | 9/2020 | F42B 12/78 |

* cited by examiner

*Primary Examiner* — James S Bergin
(74) *Attorney, Agent, or Firm* — Nasr Patent Law LLC; Faisal K. Abou-Nasr

(57) ABSTRACT

The present invention comprises a novel device, a ceramic cap that is firmly attached in a manner that prevents relative rotation axial movement or separation between the modified tip of an existing bullet and said cap to allow the modified bullet to shatter the glass of an automotive or truck windshield on contact, thus allowing the bullet to pass through the glass with a reduction of deflection incurred by non-modified bullets while producing larger bullet holes and areas of glass disruption than non-modified rounds and increasing the quantity and size of injury inflicting shrapnel.

4 Claims, 11 Drawing Sheets

FIG. 41
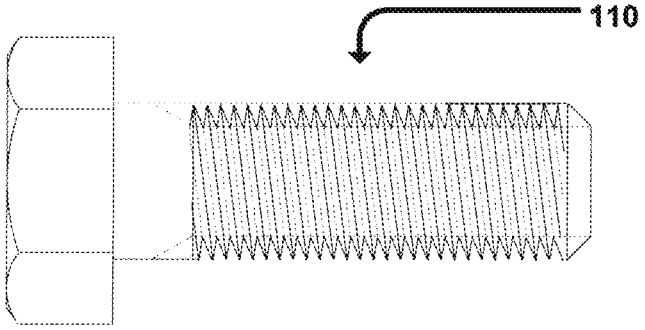
FIG. 42
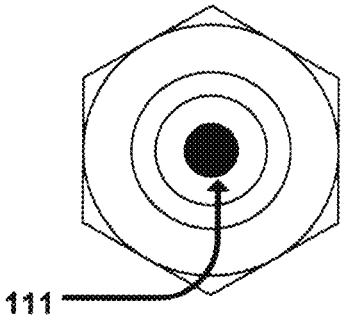
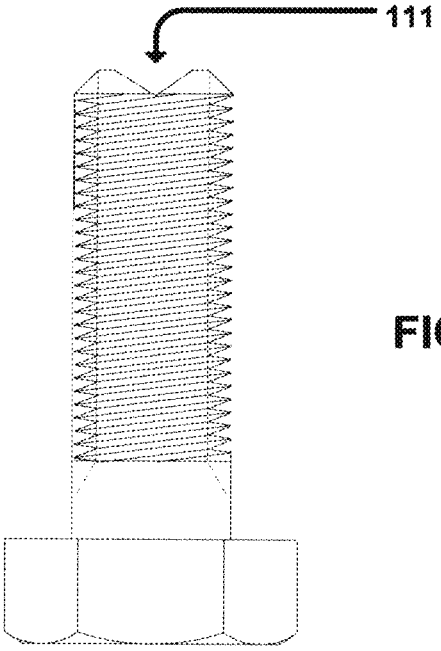
FIG. 43

CERAMIC BULLET TIP TO ASSIST BULLETS IN SHATTERING GLASS

CROSS-REFERENCE TO RELATED APPLICATIONS

This application claims the benefit of Applicants' prior Provisional patent application, No. 62/449,083, filed on Jan. 22, 2017.

STATEMENT REGARDING FEDERALLY SPONSORED RESEARCH OR DEVELOPMENT

This invention was not made by an agency of the United States Government or under a contract with an agency of the United States Government This invention was not made by an agency of any City, County or State Government or under a contract with an agency of any City, County or State Government.

THE NAMES OF THE PARTIES TO A JOINT RESEARCH AGREEMENT

Not applicable

REFERENCE TO A SEQUENCE LISTING

Not applicable

STATEMENT REGARDING PRIOR DISCLOSURES BY AN INVENTOR

This inventor filed a provisional patent application for said cap (this invention); No. 62/449,083, which was filed on Jan. 22, 2017. The United States Patent and Trademark Office forwarded the contents of that application to the Omaha, Nebr. office of the Federal Bureau of Investigation (FBI). Special Agents from that office contacted this inventor to ensure that this invention would not be used against law enforcement, military officials or the public. To the best knowledge of this inventor, neither the officers of the FBI, nor this inventor, have disclosed this invention to any other individual.

FIELD OF THE INVENTION

The present invention, a ceramic cap relates to the general field of ammunition, specifically to compositions of matter and methods of ceramic caps (this invention) produced by the injection molding process and the affixing of said ceramic cap (this invention) to a bullet to assist the bullet in penetrating glass in an automobile or truck windshield with less deflection than similar rounds that have not been modified.

DESCRIPTION OF RELATED ART

Not applicable

BACKGROUND OF THE INVENTION

With increasing frequency, law enforcement officers and military personnel are placed in a situation where they are required to shoot through the windshield of a vehicle, typically in the case of a car bomb or a driver using his/her vehicle as a weapon to attempt running over innocent victims.

The challenge law enforcement officers and military personnel face is that when a bullet hits glass, which is sloped and curved, the bullet can be deflected as much as 355.6 mm (14 inches) down and 304.8 mm (12 inches) to the left.

The amount of deflection is determined by factors such as the weight, shape and speed of the bullet, the angle of the shot, the type of glass, the temperature of the glass, the angle of the glass and more.

To reduce the complexity of these split-second decisions, I have developed a ceramic cap (this invention) that can be attached to the nose of almost any size or shape of common bullet. The hardness of this particular ceramic shatters the glass upon impact and allows for the bullet to follow much closer to its intended path.

After producing prototypes ceramic caps (this invention) and attaching them to 9 mm 115 grain bullets which have had 5.334 mm (0.210 inches) removed from the tip, tests were conducted with automobile and truck windshields. The windshields were at a slope of 45 degrees and a tilt of 10 degrees. A target was positioned 457.2 mm (18 inches) from the center point of the windshield. The unmodified rounds deflected an average of 106.68 mm (4.20 inches) while the modified rounds deflected an average of 18.034 mm (0.71 inches), which is a 591.55% variation.

The unmodified bullets shrapnel areas average about 4,318 square mm (170 square inches). The area for the bullets with the hollow point ceramic cap (this invention) is about 8,026.4 square mm (316 square inches), which is a 185.88% variation. For the unmodified bullets, only about 20% of the shrapnel was of sufficient size to inflict injury. For the bullets modified with said cap (this invention), over 40% of the shrapnel impacts within the target area appeared to be of sufficient size to inflict injury. When coupled to the observation that the bullets modified with said cap (this invention) produced an average of over 400% more shrapnel than the unmodified bullets, the modified bullets, with said cap (this invention), produced an average of over 1400 more potential injury inflicting shrapnel wounds (1600 vs. 200).

From the same test, the bullet hole height and bullet hole width for the unmodified bullets averaged 17.4625 mm (0.6875 inches) by 9.525 mm (0.3750 inches) or 6.5484375 square mm (0.2578125 square inches). The modified bullet produced an average bullet hole 22.225 mm (0.8750 inches) by 14.2875 mm (0.5625 inches) or 12.5015625 square mm (0.4921875 square inches) which is 190.91% larger. If a follow up shot were to be required, the larger bullet hole from the first shot would make a follow up shot more predictable.

From the same series of tests, the area that glass was shattered by the unmodified bullets averaged 45.72 mm (1.8 inches) by 38.1 mm (1.5 inches) or a total of 68.58 square mm (2.7 square inches). The modified bullets produced an area of shattered glass was 55.88 mm (2.2 inches) by 50.8 mm (2.0 inches) or 111.76 square mm (4.40 square inches), which is a 162.96% increase. If a follow up shot were to be required, the larger area of shattered glass from the first shot would make a follow up shot more predictable.

Tests were conducted with truck windshields. The truck windshields were at a slope of 45 degrees and a tilt of 5 degrees. While car windshields are 6.35 mm (¼ inch) thick, truck windshields are 12.70 mm (½ inch) thick. A target was positioned 457.2 mm (18 inches) from the center point of the windshield.

With truck windshields, the shrapnel area for the unmodified rounds averaged about 2011.68 square mm (79.2 square inches), the shrapnel area for the modified rounds was about 8851.9 mm (348.5 square inches) (440.02% larger).

As is illustrated in FIG. 31, when a bullet strikes window glass 83 that is sloped with the top further away from the shooter, on a path 81 that strikes the glass at an angle of 20 to 60 degrees from the initial vector, the bottom of the bullet 80 is slowed down before the top 82 of the bullet is. This results in the bullet changing its path in an unpredictable 84 manner.

When said cap (this invention) impacts the windshield (FIG. 32), said cap (this invention) produces a shattered/weakened area that lacks the strength and the integrity to deflect the bullet as much as if the bullet had been unmodified.

When the modified bullet has passed through the first layer of glass 85 it encounters a plastic barrier 86, then passes through the second layer of glass 87. The modified bullet is further slightly deflected by this barrier, while the bullet with said cap (this invention) slices through the plastic layer 85, again the unmodified round is further minimally deflected while the bullet with said cap (this invention) shatters the glass with the first edge of said cap to make contact with the glass. These result in the unmodified bullet being further deflected while the bullet modified by the addition of said cap (this invention) continues much closer to its intended/predictable path. Unmodified bullets have been shown to deflect 591.55% more than modified bullets.

Traditionally, the issue of the unpredictability of bullets passing through windshields has been addressed by police and military officers firing as many bullets as possible through the windshield. With every round they fired, there exists an even greater chance that an innocent bystander will be struck by one of the bullets.

BRIEF SUMMARY OF THE INVENTION

This invention is a ceramic tip for bullets to allow them to pass through glass with much less deflection than unmodified ammunition. Since the aerodynamic and ballistic characteristics of the modified bullets are minimally modified, the modified ammunition is still suitable for any applications for which the unmodified ammunition is suitable.

BRIEF DESCRIPTION OF THE SEVERAL VIEWS OF THE DRAWING

For a more complete understanding of the features and advantages of the present invention, reference is now made to the detailed description of the invention along with the accompanying figures.

In describing the invention, the said cap has two ends, the first end which shall be referred to as the base, and the second end which shall be referred to as the nose or the tip.

Some embodiments of the present invention are illustrated for a more complete understanding of the features and advantages of the present invention, as an example and are not limited by the figures of the accompanying drawings, in which like references may indicate similar elements and in which:

Figure 1:
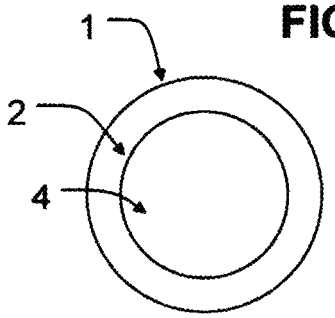

FIG. 1 depicts the top view of a ceramic cap (this invention) according to various embodiments described herein. Said cap (this invention) in the illustrated configuration is a Round Nose design. The base 1 has a height of about 1.27 mm (0.050 inches), although if needed for a specific caliber or type of ammunition, this dimension could vary and still fall under the scope and design of this device, which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip. The cap has a central raised portion 4 that is raised from the base to a height of about 3.81 mm (0.150 inches). The central raised portion of said cap (this invention) is inset from the edge of the cap by about 0.508 mm (0.020 inches) 2, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 2:
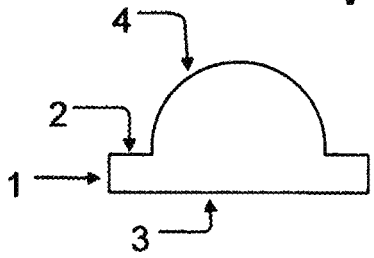

FIG. 2 depicts the side view of a ceramic cap (this invention) according to various embodiments described herein. Said cap (this invention) in the illustrated configuration is a Round Nose design. Said cap (this invention) consists of a base 1 which provides a surface for said cap to be firmly attached 3, including the use of an adhesive that may or may not contain air gaps, in a manner that prevents relative rotation or axial movement between the bullet and said cap, to a bullet that has had about 5.334 mm (0.210 inches) removed from its tip. The base 1 has a height of about 1.27 mm (0.050 inches), although if needed for a specific caliber or type of ammunition, this dimension could vary and still fall under the scope and design of this device. Said cap (this invention) has a central raised portion 4 that is raised from the base to a height of about 3.81 mm (0.150 inches). The central raised portion of said cap (this invention) is inset from the edge of the cap 2 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 3:
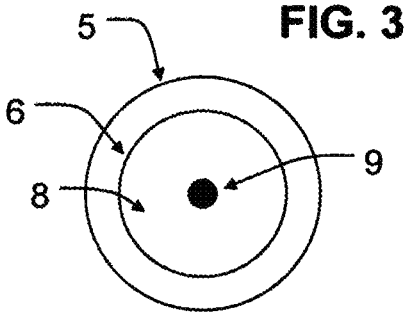

FIG. 3 depicts the top view of a ceramic cap (this invention) according to various embodiments described herein. Said cap (this invention) in the illustrated configuration is a Hollow Point Round Nose design. The base 5 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 8 that is raised from the base to a height of about 3.81 mm (0.150 inches). The central raised portion of said cap (this invention) is inset from the edge of the cap by about 0.508 mm (0.020 inches) 6, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 9. The function of the hollow point is to increase the number of sharp areas in the nose of the cap, thus increasing the amount of damage done to the windshield as the bullet passes through, thus allowing more predictable and "safer for bystanders" bullet trajectories.

Figure 4:
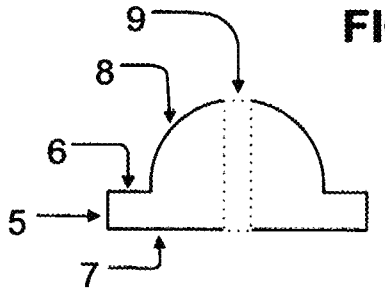

FIG. 4 depicts a ceramic cap (this invention) according to various embodiments described herein. Said cap (this invention) in the illustrated configuration is a Hollow Point Round Nose design. The cap consists of a base 5 which provides a surface 7 for said cap to be firmly attached in a manner that prevents relative rotation or axial movement between the bullet and said cap, to a bullet that has had about 5.334 mm (0.210 inches) removed from its tip. The base 5 has a height of about 1.27 mm (0.050 inches), although if needed for a specific caliber or type of ammunition, this dimension could vary and still fall under the scope and design of this device. The cap has a central raised portion 8 that is raised from the base to a height of about 3.81 mm (0.150 inches). The central raised portion of said cap (this invention) is inset from the edge of the cap 6 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 9. The pit has a height of about 3.81 mm (0.150 inches) and a diameter of about 1.27 mm (0.050 inches). The function of the hollow point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories. In most conventional ammunition, a hollow point design is intended to allow the bullet to expand upon impact. In this application, due to the hardness of the said cap, expansion does not occur.

Figure 5:
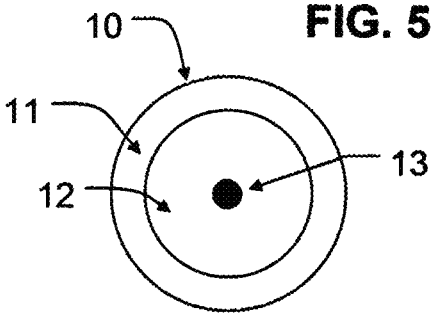

FIG. 5 depicts the top view of a ceramic cap (this invention) according to various embodiments described herein. Said cap (this invention) in the illustrated configuration is a Shallow Hollow Point Round Nose design. The base 10 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 12 that is raised from the base to a height of about 3.81 mm (0.150 inches). The central raised portion of said cap (this invention) is inset from the edge of the cap by about 0.508 mm (0.020 inches) 11, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 13. The function of the hollow point is to increase the number of sharp areas in the nose of the cap, thus increasing the amount of damage done to the windshield as the bullet passes through, thus allowing more predictable and "safer for bystanders" bullet trajectories.

Figure 6:
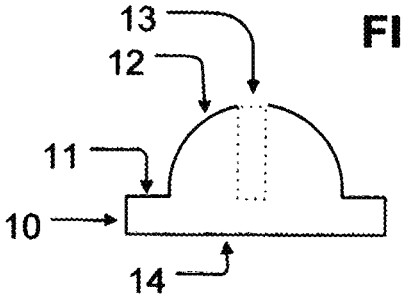

FIG. 6 depicts a ceramic cap (this invention) according to various embodiments described herein. Said cap (this invention) in the illustrated configuration is a Shallow Hollow Point Round Nose design. The cap consists of a base 10 which provides a surface 14 for said cap to be firmly attached in a manner that prevents relative rotation or axial movement between the bullet and said cap, to a bullet that has had about 5.334 mm (0.210 inches) removed from its tip. The base 10 has a height of about 1.27 mm (0.050 inches), although if needed for a specific caliber or type of ammunition, this dimension could vary and still fall under the scope and design of this device. The cap has a central raised portion 12 that is raised from the base to a height of about 3.81 mm (0.150 inches). The central raised portion of said cap (this invention) is inset from the edge of the cap 11 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 13. The pit has a height of about 3.81 mm (0.150 inches) and a diameter of about 1.27 mm (0.050 inches). The function of the hollow point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories. In most conventional ammunition, a hollow point design is intended to allow the bullet to expand upon impact. In this application, due to the hardness of the said cap, expansion does not occur.

Figure 7:
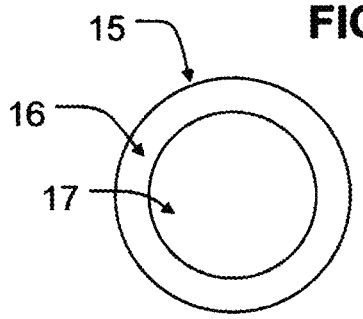

FIG. 7 depicts the top view of a ceramic cap (this invention) according to various embodiments described herein. Said cap (this invention) in the illustrated configuration is a Wad Cutter design. The base 15 has a height of about 1.27 mm (0.050 inches), although if needed for a specific caliber or type of ammunition, this dimension could vary and still fall under the scope and design of this device, which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip. The cap has a central raised portion 17 that is raised from the base to a height of about 3.81 mm (0.150 inches). The central raised portion of said cap (this invention) is inset from the edge of the cap by about 0.508 mm (0.020 inches) 16, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 8:
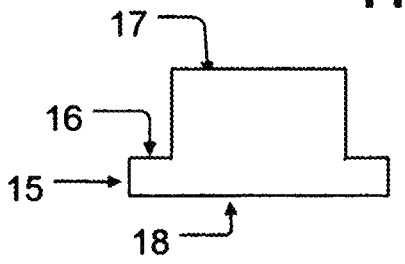

FIG. 8 depicts the side view of a ceramic cap (this invention) according to various embodiments described herein. Said cap (this invention) in the illustrated configuration is a Wad Cutter design. Said cap (this invention) consists of a base 15 which provides a surface for said cap to be firmly attached 18, including the use of an adhesive that may or may not contain air gaps, in a manner that prevents relative rotation or axial movement between the bullet and said cap, to a bullet that has had about 5.334 mm (0.210 inches) removed from its tip. The base 15 has a height of about 1.27 mm (0.050 inches), although if needed for a specific caliber or type of ammunition, this dimension could vary and still fall under the scope and design of this device. Said cap (this invention) has a central raised portion 17 that is raised from the base to a height of about 3.81 mm (0.150 inches). The central raised portion of said cap (this invention) is inset from the edge of the cap 16 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 9:
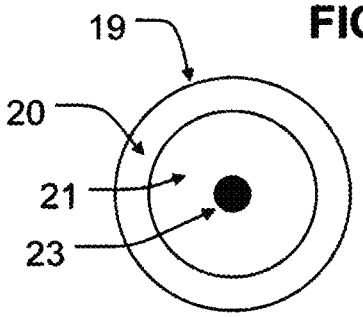

FIG. 9 depicts the top view of a ceramic cap (this invention) according to various embodiments described herein. Said cap (this invention) in the illustrated configuration is a Hollow Point Wad Cutter design. The base 19 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 21 that is raised from the base to a height of about 3.81 mm (0.150 inches). The central raised portion of said cap (this invention) is inset from the edge of the cap by about 0.508 mm (0.020 inches) 20, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 23. The function of the hollow point is to increase the number of sharp areas in the nose of the cap, thus increasing the amount of damage done to the windshield as the bullet passes through, thus allowing more predictable and "safer for bystanders" bullet trajectories.

Figure 10:
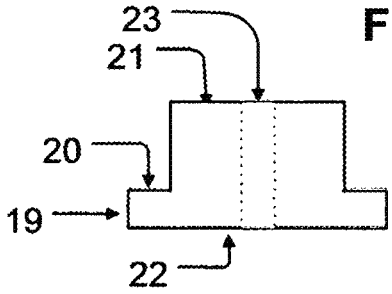

FIG. 10 depicts a ceramic cap (this invention) according to various embodiments described herein. Said cap (this invention) in the illustrated configuration is a Shallow Hollow Point Wad Cutter design. The cap consists of a base 19 which provides a surface for said cap to be firmly attached in a manner that prevents relative rotation or axial movement between the bullet and said cap, to a bullet that has had about 5.334 mm (0.210 inches) removed from its tip. The base 24 has a height of about 1.27 mm (0.050 inches), although if needed for a specific caliber or type of ammunition, this dimension could vary and still fall under the scope and design of this device. The cap has a central raised portion 26 that is raised from the base to a height of about 3.81 mm (0.150 inches). The central raised portion of said cap (this invention) is inset from the edge of the cap 25 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 23. The pit has a height of about 3.81 mm (0.150 inches) and a diameter of about 1.27 mm (0.050 inches). The function of the hollow point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories. In most conventional ammunition, a hollow point design is intended to allow the bullet to expand upon impact. In this application, due to the hardness of the said cap, expansion does not occur.

Figure 11:
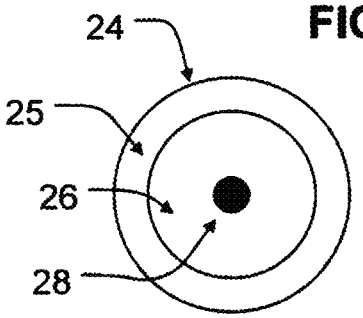

FIG. 11 depicts the top view of a ceramic cap (this invention) according to various embodiments described herein. Said cap (this invention) in the illustrated configuration is a Shallow Hollow Point Wad Cutter design. The base 24 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 26 that is raised from the base to a height of about 3.81 mm (0.150 inches). The central raised portion of said cap (this invention) is inset from the edge of the cap by about 0.508 mm (0.020 inches) 25, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 28. The pit has a height of about 3.81 mm (0.150 inches) and a diameter of about 1.27 mm (0.050 inches). The function of the hollow point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories. In most conventional ammunition, a hollow point design is intended to allow the bullet to expand upon impact. In this application, due to the hardness of the said cap, expansion does not occur.

Figure 12:
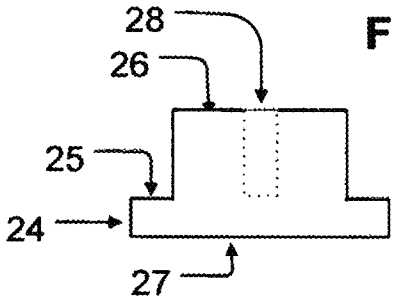

FIG. 12 depicts a ceramic cap (this invention) according to various embodiments described herein. Said cap (this invention) in the illustrated configuration is a Semi Wad Cutter design. The cap consists of a base 24 which provides a surface for said cap to be firmly attached in a manner that prevents relative rotation or axial movement between the bullet and said cap, to a bullet that has had about 5.334 mm (0.210 inches) removed from its tip. The base 24 has a height of about 1.27 mm (0.050 inches), although if needed for a specific caliber or type of ammunition, this dimension could vary and still fall under the scope and design of this device. The cap has a central raised portion 26 that is raised from the base to a height of about 3.81 mm (0.150 inches). The central raised portion of said cap (this invention) is inset from the edge of the cap 25 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 13:
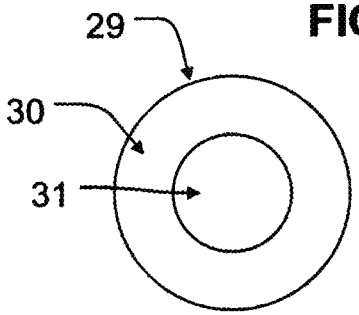

FIG. 13 depicts the top view of a ceramic cap (this invention) according to various embodiments described herein. Said cap (this invention) in the illustrated configuration is a Semi Wad Cutter design. The base 29 has a height of about 1.27 mm (0.050 inches), although if needed for a specific caliber or type of ammunition, this dimension could vary and still fall under the scope and design of this device, which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip. The cap has a central raised portion 31 that is raised from the base to a height of about 3.81 mm (0.150 inches). The central raised portion of said cap (this invention) is inset from the edge of the cap by about 1.016 mm (0.040 inches) 30, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 14:
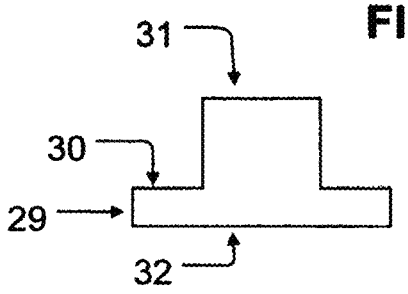

FIG. 14 depicts the side view of a ceramic cap (this invention) according to various embodiments described herein. Said cap (this invention) in the illustrated configuration is a Hollow Point Semi Wad Cutter design. Said cap (this invention) consists of a base 29 which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip. The base 29 has a height of about 1.27 mm (0.050 inches), although if needed for a specific caliber or type of ammunition, this dimension could vary and still fall under the scope and design of this device. Said cap (this invention) has a central raised portion 31 that is raised from the base to a height of about 3.81 mm (0.150 inches). The central raised portion of said cap (this invention) is inset from the edge of the cap 30 by 1.016 mm (0.040 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 15:
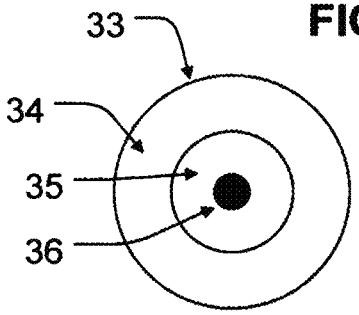

FIG. 15 depicts the top view of a ceramic cap (this invention) according to various embodiments described herein. Said cap (this invention) in the illustrated configuration is a Hollow Point Semi Wad Cutter design. The base 30 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 35 that is raised from the base to a height of about 3.81 mm (0.150 inches). The central raised portion of said cap (this invention) is inset from the edge of the cap by about 1.016 mm (0.040 inches) 34, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 36. The function of the hollow point is to increase the number of sharp areas in the nose of the cap, thus increasing the amount of damage done to the windshield as the bullet passes through, thus allowing more predictable and "safer for bystanders" bullet trajectories.

Figure 16:
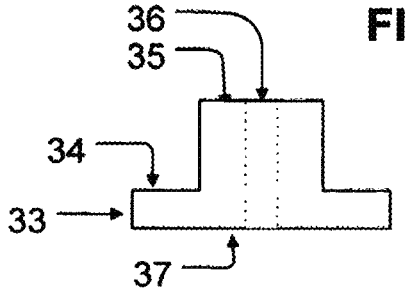

FIG. 16 depicts a ceramic cap (this invention) according to various embodiments described herein. Said cap (this invention) in the illustrated configuration is a Shallow Hollow Point Semi Wad Cutter design. The cap consists of a base 33 which provides a surface for said cap to be firmly attached in a manner that prevents relative rotation or axial movement between the bullet and said cap, to a bullet that has had about 5.334 mm (0.210 inches) removed from its tip. The base 33 has a height of about 1.27 mm (0.050 inches), although if needed for a specific caliber or type of ammunition, this dimension could vary and still fall under the scope and design of this device. The cap has a central raised portion 36 that is raised from the base to a height of about 3.81 mm (0.150 inches). The central raised portion of said cap (this invention) is inset from the edge of the cap 34 by 1.016 mm (0.040 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 36. The pit has a height of about 3.81 mm (0.150 inches) and a diameter of about 1.27 mm (0.050 inches). The function of the hollow point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories. In most conventional ammunition, a hollow point design is intended to allow the bullet to expand upon impact. In this application, due to the hardness of the said cap, expansion does not occur.

Figure 17:
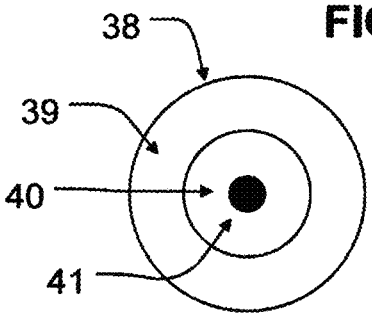

FIG. 17 depicts the top view of a ceramic cap (this invention) according to various embodiments described herein. Said cap (this invention) in the illustrated configuration is a Shallow Hollow Point Semi Wad Cutter design. The base 38 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 40 that is raised from the base to a height of about 3.81 mm (0.150 inches). The central raised portion of said cap (this invention) is inset from the edge of the cap by about 1.016 mm (0.020 inches) 39, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 41. The function of the hollow point is to increase the number of sharp areas in the nose of the cap, thus increasing the amount of damage done to the windshield as the bullet passes through, thus allowing more predictable and "safer for bystanders" bullet trajectories.

Figure 18:
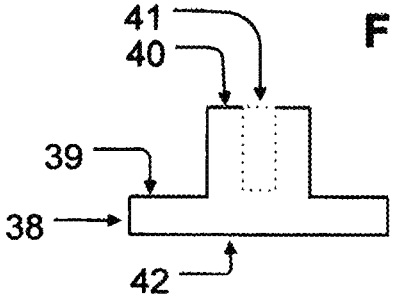

FIG. 18 depicts a ceramic cap (this invention) according to various embodiments described herein. Said cap (this invention) in the illustrated configuration is a Shallow Hollow Point Semi Wad Cutter design. The cap consists of a base 38 which provides a surface 42 for said cap to be firmly attached in a manner that prevents relative rotation or axial movement between the bullet and said cap, to a bullet that has had about 5.334 mm (0.210 inches) removed from its tip. The base 38 has a height of about 1.27 mm (0.050 inches), although if needed for a specific caliber or type of ammunition, this dimension could vary and still fall under the scope and design of this device. The cap has a central raised portion 40 that is raised from the base to a height of about 3.81 mm (0.150 inches). The central raised portion of said cap (this invention) is inset from the edge of the cap 39 by 1.016 mm (0.040 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 41. The function of the hollow point is to increase the number of sharp areas in the nose of the cap, thus increasing the amount of damage done to the windshield as the bullet passes through, thus allowing more predictable and "safer for bystanders" bullet trajectories.

Figure 19:
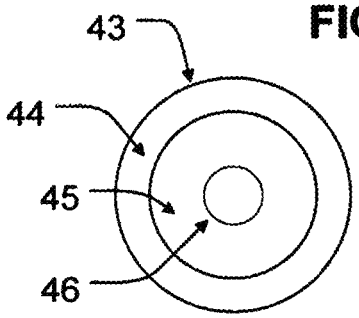

FIG. 19 depicts the top view of a ceramic cap (this invention) according to various embodiments described herein. Said cap (this invention) in the illustrated configuration is a Truncated Spire Point design. The base 43 has a height of about 1.27 mm (0.050 inches), although if needed for a specific caliber or type of ammunition, this dimension could vary and still fall under the scope and design of this device, which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip. The cap has a central raised portion 45 that is raised from the base to a height of about 3.81 mm (0.150 inches). The raised portion has a truncated top 46. The central raised portion of said cap (this invention) is inset from the edge of the cap by about 0.508 mm (0.020 inches) 44, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 20:
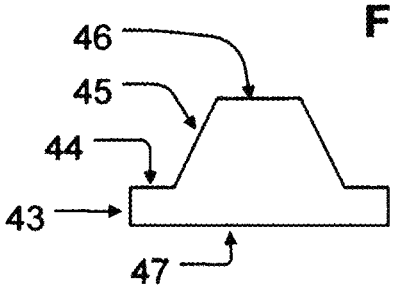

FIG. 20 depicts the side view of a ceramic cap (this invention) according to various embodiments described herein. Said cap (this invention) in the illustrated configuration is a Hollow Point Truncated Spire Point design. Said cap (this invention) consists of a base 43 which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip. The base 43 has a height of about 1.27 mm (0.050 inches), although if needed for a specific caliber or type of ammunition, this dimension could vary and still fall under the scope and design of this device. Said cap (this invention) has a central raised portion 51 that is raised from the base to a height of about 3.81 mm (0.150 inches). The raised portion has a truncated top 52. The central raised portion of said cap (this invention) is inset from the edge of the cap 49 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim.

Figure 21:
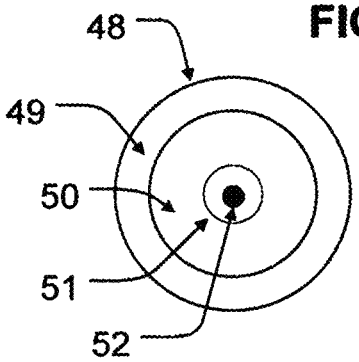

FIG. 21 depicts the top view of a ceramic cap (this invention) according to various embodiments described herein. Said cap (this invention) in the illustrated configuration is a Hollow Point Truncated Spire Point design. The base 48 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 50 that is raised from the base to a height of about 3.81 mm (0.150 inches). The raised portion has a truncated top 51. The central raised portion of said cap (this invention) is inset from the edge of the cap by about 0.508 mm (0.020 inches) 49, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 52. The function of the hollow point is to increase the number of sharp areas in the nose of the cap, thus increasing the amount of damage done to the windshield as the bullet passes through, thus allowing more predictable and "safer for bystanders" bullet trajectories.

Figure 22:
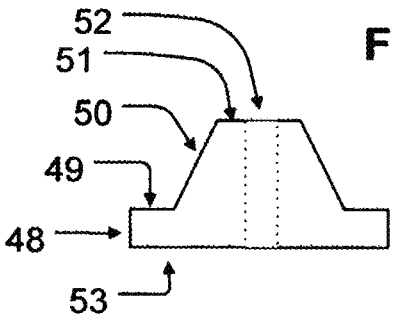

FIG. 22 depicts a ceramic cap (this invention) according to various embodiments described herein. Said cap (this invention) in the illustrated configuration is a Hollow Point Wad Cutter design. The cap consists of a base 48 which provides a surface 53 for said cap to be firmly attached in a manner that prevents relative rotation or axial movement between the bullet and said cap, to a bullet that has had about 5.334 mm (0.210 inches) removed from its tip. The base 48 has a height of about 1.27 mm (0.050 inches), although if needed for a specific caliber or type of ammunition, this dimension could vary and still fall under the scope and design of this device. The cap has a central raised portion 50 that is raised from the base to a height of about 3.81 mm (0.150 inches). The raised portion has a truncated top 51. The central raised portion of said cap (this invention) is inset from the edge of the cap 49 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 52. The pit has a height of about 3.81 mm (0.150 inches) and a diameter of about 1.27 mm (0.050 inches). The function of the hollow point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories. In most conventional ammunition, a hollow point design is intended to allow the bullet to expand upon impact. In this application, due to the hardness of the said cap, expansion does not occur.

Figure 23:
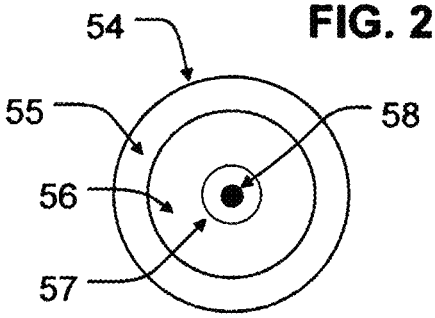

FIG. 23 depicts the top view of a ceramic cap (this invention) according to various embodiments described herein. Said cap (this invention) in the illustrated configuration is a Shallow Hollow Point Wad Cutter design. The base 54 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 56 that is raised from the base to a height of about 3.81 mm (0.150 inches). The central raised portion of said cap (this invention) is inset from the edge of the cap by about 0.508 mm (0.020 inches) 55, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 58. The function of the hollow point is to increase the number of sharp areas in the nose of the cap, thus increasing the amount of damage done to the windshield as the bullet passes through, thus allowing more predictable and "safer for bystanders" bullet trajectories.

Figure 24:
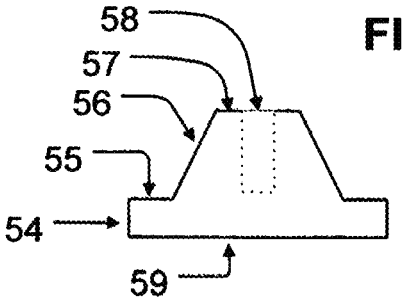

FIG. 24 depicts the top view of a ceramic cap (this invention) according to various embodiments described herein. Said cap (this invention) in the illustrated configuration is a Truncated Spire Point design. The cap consists of a base 54 which provides a surface 59 for said cap to be firmly attached in a manner that prevents relative rotation or axial movement between the bullet and said cap, to a bullet that has had about 5.334 mm (0.210 inches) removed from its tip. The base 54 has a height of about 1.27 mm (0.050 inches), although if needed for a specific caliber or type of ammunition, this dimension could vary and still fall under the scope and design of this device. The cap has a central raised portion 56 that is raised from the base to a height of about 3.81 mm (0.150 inches). The central raised portion of said cap (this invention) is inset from the edge of the cap 55 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is truncated point that produces a flat tip 57. At the center of the flat tip of the cap is a pit or hollowed out shape in its tip 58. The function of the flat tip and the hollow point is to increase the number of sharp areas in the nose of the cap, thus increasing the amount of damage done to the windshield as the bullet passes through, thus allowing more predictable and "safer for bystanders" bullet trajectories.

Figure 25:
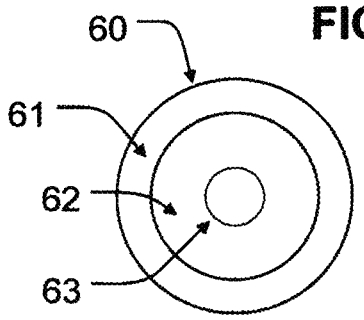

FIG. 25 depicts the front view of a ceramic cap (this invention) according to various embodiments described herein. Said cap (this invention) in the illustrated configuration is a Truncated Spire Point design. The cap consists of a base 60 which provides a surface for said cap to be firmly attached in a manner that prevents relative rotation or axial movement between the bullet and said cap, to a bullet that has had about 5.334 mm (0.210 inches) removed from its tip. The base 60 has a height of about 1.27 mm (0.050 inches), although if needed for a specific caliber or type of ammunition, this dimension could vary and still fall under the scope and design of this device. The cap has a central raised portion 63 that is raised from the base to a height of about 3.81 mm (0.150 inches). The central raised portion of said cap (this invention) is inset from the edge of the cap 61 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is truncated point that produces a flat tip 63. The function of the flat point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories.

Figure 26:
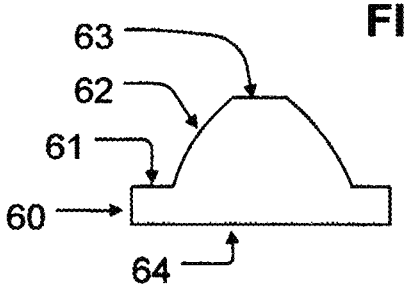

FIG. 26 depicts the front view of a ceramic cap (this invention) according to various embodiments described herein. Said cap (this invention) in the illustrated configuration is a Shallow Hollow Point Truncated Spire Point design. The cap consists of a base 60 which provides a surface for said cap to be firmly attached in a manner that prevents relative rotation or axial movement between the bullet and said cap, to a bullet that has had about 5.334 mm (0.210 inches) removed from its tip. The base 60 has a height of about 1.27 mm (0.050 inches), although if needed for a specific caliber or type of ammunition, this dimension could vary and still fall under the scope and design of this device. The cap has a central raised portion 62 that is raised from the base to a height of about 3.81 mm (0.150 inches). The raised portion has a truncated top 63. The central raised portion of said cap (this invention) is inset from the edge of the cap 61 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. The function of the flat point is to increase the number of sharp areas in the nose of the cap, thus increasing the amount of damage done to the windshield as the bullet passes through, thus allowing more predictable and "safer for bystanders" bullet trajectories.

Figure 27:
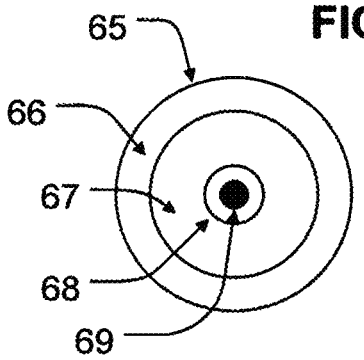

FIG. 27 depicts the top view of a ceramic cap (this invention) according to various embodiments described herein. Said cap (this invention) in the illustrated configuration is the front view of a Hollow Point Truncated Spire Point design. The base 65 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 67 that is raised from the base to a height of about 3.81 mm (0.150 inches). The raised portion of said cap (this invention) has a truncated top 68. The central raised portion of said cap (this invention) is inset from the edge of the cap by about 0.508 mm (0.020 inches) 66, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 69. The function of the hollow point is to increase the number of sharp areas in the nose of the cap, thus increasing the amount of damage done to the windshield as the bullet passes through, thus allowing more predictable and "safer for bystanders" bullet trajectories.

Figure 28:
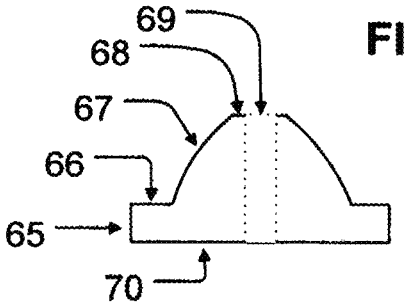

FIG. 28 depicts a ceramic cap (this invention) according to various embodiments described herein. Said cap (this invention) in the illustrated configuration is a Hollow Point Truncated Spire Point design. The cap consists of a base 65 which provides a surface for said cap to be firmly attached in a manner that prevents relative rotation or axial movement between the bullet and said cap, to a bullet that has had about 5.334 mm (0.210 inches) removed from its tip. The base 65 has a height of about 1.27 mm (0.050 inches), although if needed for a specific caliber or type of ammunition, this dimension could vary and still fall under the scope and design of this device. The cap has a central raised portion 67 that is raised from the base to a height of about 3.81 mm (0.150 inches). The raised portion has a truncated top 68. The central raised portion of said cap (this invention) is inset from the edge of the cap 66 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 69. The pit has a height of about 3.81 mm (0.150 inches) and a diameter of about 1.27 mm (0.050 inches). The function of the hollow point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories. In most conventional ammunition, a hollow point design is intended to allow the bullet to expand upon impact. In this application, due to the hardness of the said cap, expansion does not occur.

Figure 29:
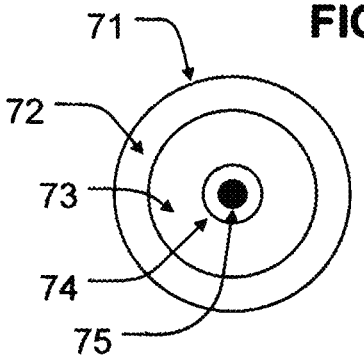

FIG. 29 depicts the top view of a ceramic cap (this invention) according to various embodiments described herein. Said cap (this invention) in the illustrated configuration is the front view of a Shallow Hollow Point Truncated Spire Point design. The base 71 has a height of about 1.27 mm (0.050 inches), which provides a surface for said cap to be firmly attached, including the use of an adhesive that may or may not contain air gaps, in a manner that prevents relative rotation or axial movement between the bullet and said cap, to a bullet that has had about 5.334 mm (0.210 inches) removed from its tip, although if needed for a specific caliber or type of ammunition, this dimension could vary and still fall under the scope and design of this device. The cap has a central raised portion 73 that is raised from the base to a height of about 3.81 mm (0.150 inches). The central raised portion of said cap (this invention) is inset from the edge of the cap by about 0.508 mm (0.020 inches) 71, although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 75. The function of the hollow point is to increase the number of sharp areas in the nose of the cap, thus increasing the amount of damage done to the windshield as the bullet passes through, thus allowing more predictable and "safer for bystanders" bullet trajectories.

Figure 30:
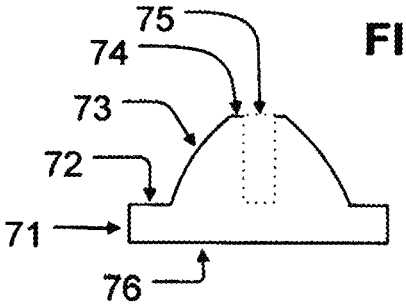

FIG. 30 depicts a ceramic cap (this invention) according to various embodiments described herein. Said cap (this invention) in the illustrated configuration is a Shallow Hollow Point Truncated Spire Point design. The cap consists of a base 71 which provides a surface 76 for said cap to be firmly attached in a manner that prevents relative rotation or axial movement between the bullet and said cap, to a bullet that has had about 5.334 mm (0.210 inches) removed from its tip. The base 71 has a height of about 1.27 mm (0.050 inches), although if needed for a specific caliber or type of ammunition, this dimension could vary and still fall under the scope and design of this device. The cap has a central raised portion 73 that is raised from the base to a height of about 3.81 mm (0.150 inches). The raised portion has a truncated top 74. The central raised portion of said cap (this invention) is inset from the edge of the cap 72 by about 0.508 mm (0.020 inches), although if needed for a specific caliber or type of ammunition, this dimension could vary and still fall under the scope and design of this device. All such equivalent embodiments and examples are within the spirit and scope of the present invention, are contemplated thereby, and are intended to be covered by this claim. At the center of the top of the cap is a pit or hollowed out shape in its tip 75. The pit has a height of about 3.81 mm (0.150 inches) and a diameter of about 1.27 mm (0.050 inches). The function of the hollow point is to increase the number of sharp areas in the nose of the cap, thus increasing the amount of damage done to the windshield as the bullet passes through, thus increasing the amount of damage done to the windshield as the bullet passes through, thus allowing more predictable and "safer for bystanders" bullet trajectories. In most conventional ammunition, a hollow point design is intended to allow the bullet to expand upon impact. In this application, due to the hardness of the said cap, expansion does not occur.

Figure 31:
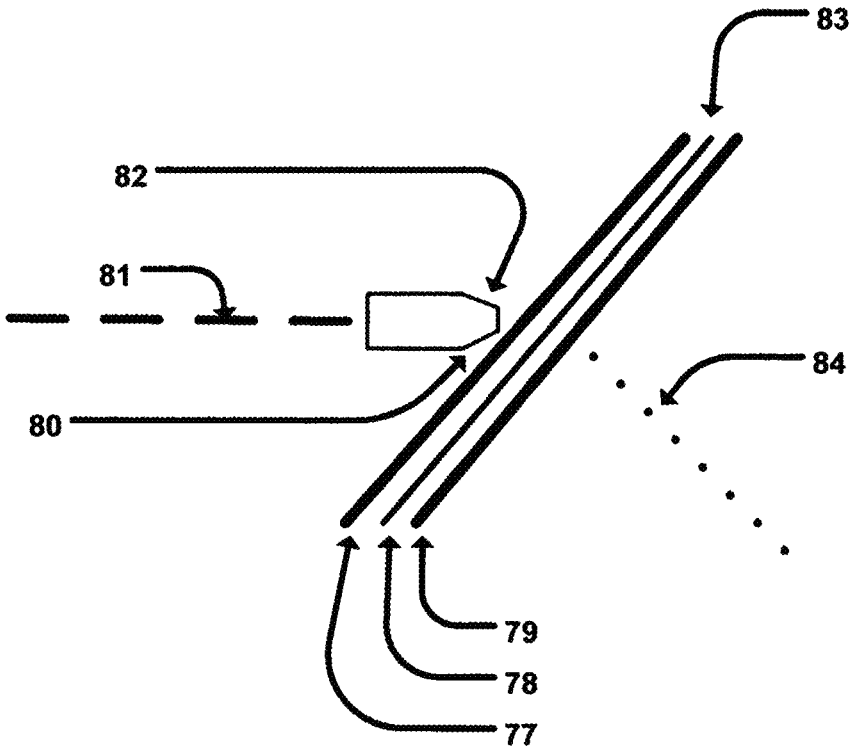

FIG. 31 depicts the path 81 taken by a bullet when the first edge of the bullet 80 strikes glass before the second edge 82 strikes the first layer of glass 77, then the plastic layer 78 then the second glass layer 79, resulting in the deflected path 84. The windshield 83 is composed of laminated layers 77, 78, 79.

Figure 32:
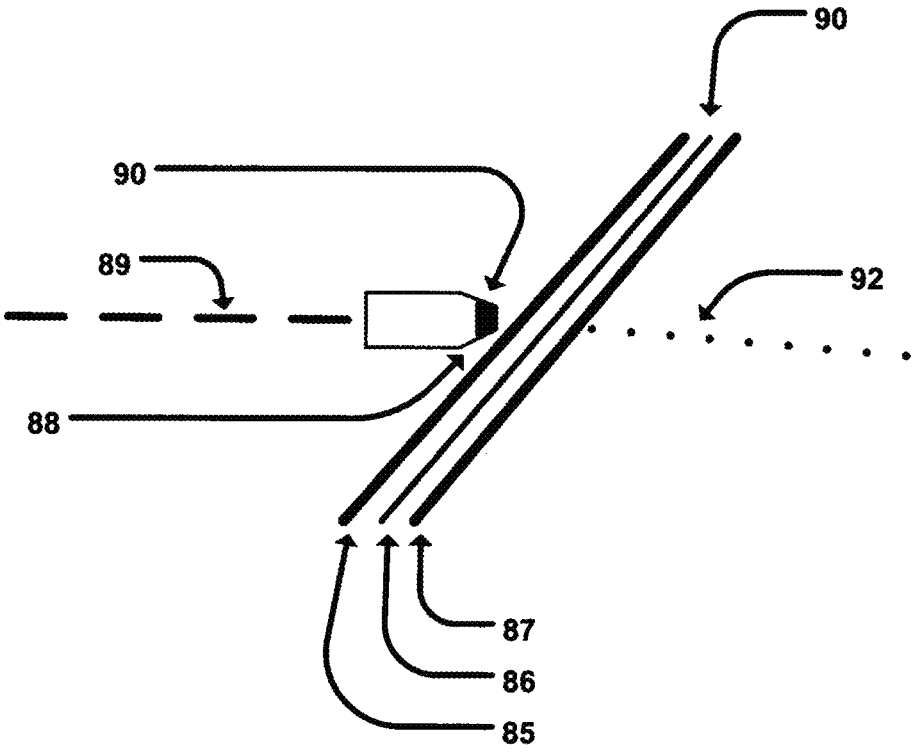

FIG. 32 depicts the path 89 taken by a modified bullet when the first edge of the bullet 88 strikes glass before the second edge 90 strikes the first layer of glass, then the plastic layer 86 then the second glass layer 87, resulting in the less deflected path 92. The windshield 91 is composed of laminated layers 85, 86, 87.

Figure 33:
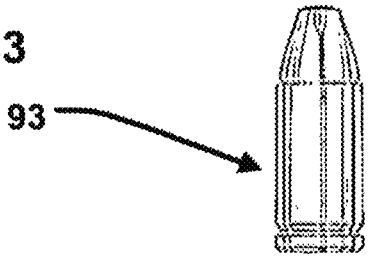

FIG. 33 depicts an unmodified 9 mm bullet 93.

Figure 34:
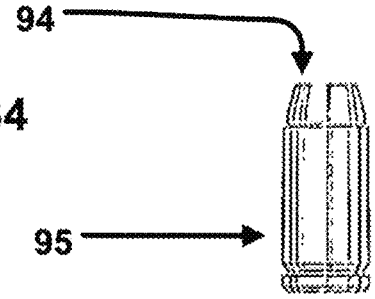

FIG. 34 depicts an unmodified 9 mm bullet 95 with about 5.334 mm (0.210 inches) removed 94.

Figure 35:
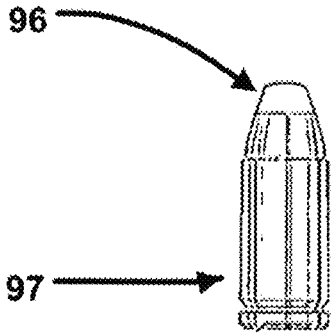

FIG. 35 depicts an unmodified 9 mm bullet 97 with about 5.334 mm (0.210 inches) removed and replaced by the ceramic cap (this invention) 96.

Figure 36:
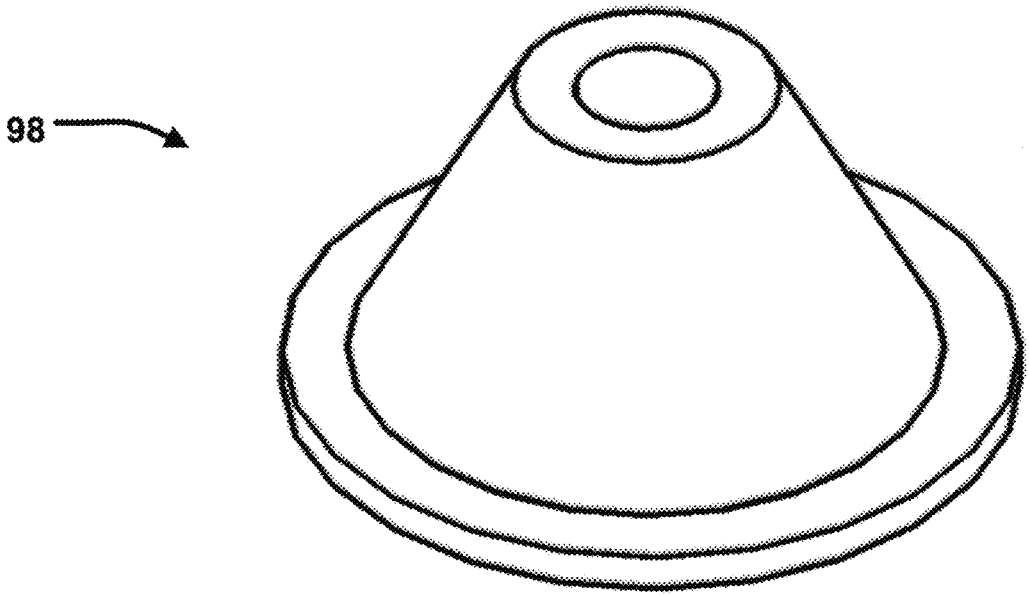

FIG. 36 depicts a generic 3-d view of a ceramic cap (this invention) 98 according to various embodiments described herein for illustrative purposes.

Figure 37:
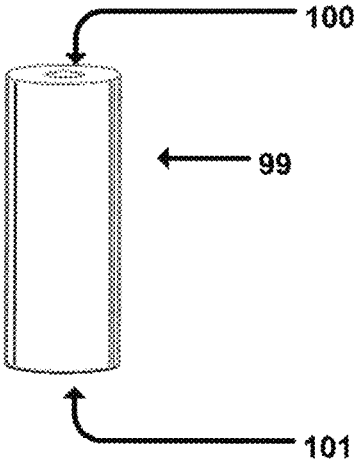

FIG. 37 depicts a cylinder of Alumina (Aluminum Oxide, $Al_2O_3$) ceramic 99 which has been removed from a spark plug. The cylinder is about 10.16 to 10.20 mm (0.400-0.500 inches) 101 in diameter and 20.32 to 20.4 mm (0.800-1.00 inches) in length 99. The cylinder 99 contains a hollow core 100 where the sparkplug contact had been.

Figure 38:
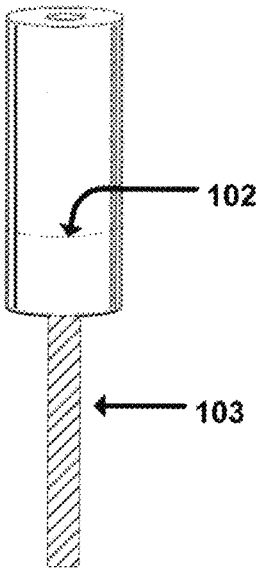

FIG. 38 depicts a cylinder of Alumina (Aluminum Oxide, $Al_2O_3$) ceramic which has been removed from a spark plug, which has had a metal rod inserted in one end 103 to use as a shaft for insertion in a drill press or lathe. The cylinder of Alumina (Aluminum Oxide, $Al_2O_3$) ceramic will be cut to the length of about 1.5 times the desired finished length 102.

Figure 39:
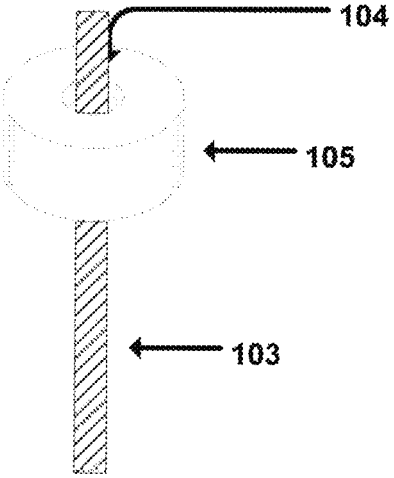

FIG. 39 depicts a cylinder of Alumina (Aluminum Oxide, $Al_2O_3$) ceramic from FIG. 38 which has been cut to the appropriate length 105. The metal rod 103 is still inserted in the channel that had been voided by removal from the spark plug 104.

Figure 40:
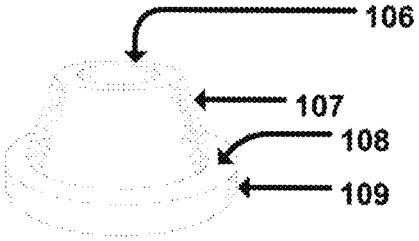

FIG. 40 depicts said cylinder of Alumina (Aluminum Oxide, $Al_2O_3$) ceramic from FIG. 39. which has been ground to the appropriate shape. A base 109 has been created. The central extension 107 has been recessed from the edge of the base 108. The void through the center of the cap 106 has formed the hollow point for the cap.

FIG. 41 depicts the side view of a ⅞ths inch unmodified bolt with #14 fine threads. 110. This bolt will fit in most standard ammunition reloading presses.

FIG. 42 depicts the bottom view of a ⅞ ths inch bolt with #14 fine threads. 110. Into the center of the bold has been drilled a cone shaped hole with the sides at a 45 degree angle 111.

FIG. 43 depicts the side view of a ⅞ inch bolt with #14 fine threads. 110. Into the center of the bold has been drilled a cone shaped hole with the sides at a 45 degree angle 111.

DETAILED DESCRIPTION OF THE INVENTION

As used in this specification and claim(s), the words are inclusive or open-ended and do not exclude additional, unrecited elements or method steps.

The terminology used herein is for the purpose of describing particular embodiments only and is not intended to be limiting to the invention. As used herein, the term "and/or" includes any and all combinations of one or more of the associated listed items. As used herein, the singular form "a", "an" and "the" are intended to include the plural forms as well as the singular forms unless the context dearly indicates otherwise.

Through out this application, the term "about" is used to indicate that a value includes the inherent variation of error for the device, the method being employed to determine the value, or the variation that exists among the study subjects.

It will be further understood that the terms "comprises" and/or "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") when used herein, specifies the presence of stated features, steps, operations, elements, and/or components, but do not include the presence or addition of one or more of the features, steps, operations, elements, components, and/or groups thereof. These terms are inclusive or open-ended and do not exclude additional, unrecited elements or method steps.

Unless otherwise defined, all terms, including technical and scientific terms, used herein, have the same meaning as commonly understood by one having ordinary skill in the art to which this invention belongs. It will further be understood that terms, such as those defined in commonly used dictionaries, should be interpreted as having a meaning that is consistent with their meaning in the context of the relevant art and the present disclosure and will not be interpreted in an idealized or overly formal sense unless expressly so defined.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless the specifications and claims should be read with the understanding that such combinations are entirely within the scope of the invention and the claims.

Said cap (this invention), apparatuses and methods for positioning the adhesive to said cap (this invention) are discussed herein in the following description, for the purpose of explanation, numerous specific details are set forth in order to provide a thorough understanding of said cap (this invention). It will be evident, however, to one skilled in the art that the present innovation may be practiced without the specific details.

The present disclosure is to be considered as an exemplification of the invention and is not intended to limit the invention to the specific embodiment illustrated by the figures or description below.

Said cap (this invention) may have a frutoconical shape, referred to as a semi wad cutter, a frutoconical shape with a cavity to form a hollow point projectile, referred to as a hollow point semi wad cutter, a frutoconical shape with a ½ depth cavity to form a shallow hollow point projectile, a spitzer shape, a spitzer shape with a cavity to form a hollow point spitzer projectile, a spitzer shape with a ½ depth cavity to form a shallow hollow point spitzer projectile, a spire shape, a spire shape with a cavity to form a hollow point spire projectile, a spire shape with a ½ depth cavity to form a shallow hollow point spire projectile, a blunted shape referred to as a wad cutter, a blunted shape with a cavity to form a hollow point wad cutter, a blunted shape with a ½ depth cavity to form a shallow hollow point wad cutter, a rounded shape, a rounded shape with a cavity to form a hollow point projectile or a rounded shape with a ½ depth cavity to form a shallow hollow point projectile. All such equivalent embodiments and examples are within the spirit and scope of the present invention, are contemplated thereby, and are intended to be covered by this claim.

FIG. 22 depicts a generic unmodified bullet with a round nosed bullet 62.

The modified bullet FIG. 23 63 shows the same bullet with 5.334 mm (0.210 inches) removed.

The modified (shortened) bullet with a ceramic cap (this invention) FIG. 24 64 is shown in according to various embodiments described herein. The tip of the bullet may either be removed during the production process or added as a post production step. FIG. 24 is the modified bullet shown in FIG. 23 with a ceramic cap (this invention) attached. Said cap (this invention) is a diameter at the base that is 0.04 inches less than the diameter of the exposed surface of the tip of the modified bullet. Said cap (this invention) is under sized by 0.04 inches in order to keep said cap (this invention) from contacting the inner surfaces of the firearm barrel, thus removing the risk of accelerated wear to the interior of the firearm barrel. Said cap (this invention) has a height of 5.08 mm (0.200 inches), which is 0.01 inches less than the amount by which the modified bullet was shortened. The slight under sizing of said cap (this invention) is specified to reduce the chance of a misfeed of the ammunition when being fired.

Said cap (this invention) is adhered to the modified bullet with a small amount of Methyl 2-cyanoacrylate or ethyl-2-cyanoacrylate (commonly sold under trade names such as "Super Glue" and "Krazy Glue"), which is placed between the forward most surface of the modified bullet and rear most surface of said cap (this invention) for said cap to be firmly attached in a manner that prevents relative rotation, axial movement or separation between the said bullet and said cap, to a bullet that has had 5.334 mm (0.210 inches) removed from its tip.

Either methyl 2-cyanoacrylate or ethyl-2-cyanoacrylate are critical components of the attachment of said cap (this invention) to the modified bullet, as their strength, vibration resistance, and heat resistance have been well documented, as NASA chose "over the counter" Methyl 2-cyanoacrylate or ethyl-2-cyanoacrylate as the adhesives of choice to secure ceramic tiles to the metallic skin of the space shuttles, where the ceramic tile were exposed extreme temperatures, vibration, acceleration and air resistance far exceeding the temperatures, vibration, acceleration and air resistance to be encountered in this application.

During testing of the bond created by the "over the counter" methyl 2-cyanoacrylate or ethyl-2-cyanoacrylate, a modified bullet was fired through four layers of the FBI "Heavy Clothing Penetration" standard, one 1/16 inch sheet of Aluminum, and terminating in compressed wet sand. (FBI "Heavy Clothing Penetration" standard is one layer of denim, one layer of fleece, one layer of "dress shirt" material and one layer of "tee shirt material"). The bullet with said cap (this invention) was tested with four times the normal amount of material. When the modified bullet with the hollow point ceramic cap (this invention) was a recovered from the compressed sand, the bullet was 98.995% intact as measured by weighing the bullet before and after the test firing on a digital scale and comparing the weights. The modified bullet with said cap (this invention) lost 1.126 grains, and said cap (this invention) was still partially attached to the nose of the bullet. In contrast, a control round (unmodified 9 mm 115 grain jacketed round nose) lost 21% of its weight (115.020 grains to 90.305 grains (78.512% of the original weight). The average penetration in compacted sand was about 9.25 inches. This is equivalent to about 13.875 inches of ballistic gel (using the "3/2" conversion standard). The FBI standard calls for one set of the fabric pack and states that bullets should penetrate the gel at least 12 inches.

Alumina (Aluminum Oxide, $Al_2O_3$) ceramic is specified for said cap (this invention) because it has the sharp angular internal structure coupled with its hardness of just less than that of a diamond (9.5-9.75 on the Moh's Hardness scale for the ceramic vs. 10.0 for a diamond), necessary for said cap to interact with the tempered glass of the windshields or windows of a vehicle, produces the desired disintegration of the windshields or windows and the reduction in deflection which unmodified suffer from.

While the preferred materials for said cap (this invention) has been described; the device is not limited to that material.

As used herein the term "shell," "bullet" and "projectile" are used interchangeably and denote a projectile that is positioned in an ammunition cartridge until it is expelled from a gun, rifle, or the like and propelled by detonation of a powdered chemical propellant or other propellant that may be non-powdered, solid, gaseous or gelatin.

Although the present invention has been illustrated and described herein, with reference to preferred embodiments and specific examples thereof, it will be readily apparent to those of ordinary skill in the art that other embodiments and examples may perform similar functions and/or achieve like results. AU such equivalent embodiments and examples are within the spirit and scope of the present invention, are contemplated thereby, and are intended to be covered by this claim.

The principal features of this invention can be employed in various embodiments without departing from the scope of the invention. As known to those of ordinary skill in the art, they will recognize, or be able to ascertain using no more than routine experimentation, numerous equivalents to the specific procedures described herein. Such equivalents are considered to be within the scope of this invention and are covered by the claims.

Production Process:

Disclaimer Please note that the methods presented in this patent allude to an extremely dangerous procedure of cutting the tip off loaded live ammunition. Excessive heat buildup, vibration or impact could cause the bullet to discharge which puts the safety and lives of the person making the caps as well as any innocent bystanders attempting the procedures illustrated here in danger. Any person or persons attempting these techniques must accept full accountability, hazard, and liabilities for all wounds (counting demise), harms, and additional misfortunes to people or properties at serious risk. The holder of this patent has no control over the actual procedures and methods being used, or the condition or choice of components used. No responsibility for the use of this information is implied or assumed. With this in mind, it is essential that you do not attempt these processes unless you take the appropriate industry standards. Any person attempting these processes does so strictly at their own risk.

There are two substantial techniques to create the ceramic caps. The first method, is the most limited production, and least accurate, however is reasonable for the creation of prototype caps for assessment and testing.

The first method is to strip the ceramic off of a spark plug, attach the ceramic to a shaft, and insert that shaft into either a lathe or a drill press, cut the cap to length forming a blank, file down the blank until correct dimensions are achieved and attach the cap to existing ammunition.

To remove the ceramic from the spark plug, hold the base of the spark plug with a wrench. Attach a pair of locking pliers to the point where the spark plug cable would be attached. Rotate the locking pliers around the central axis until the shaft inside either breaks in half or unscrews. At that point the ceramic should slip off of the spark plug. If the metal core breaks off inside of the spark plug, dispose of the spark plug and start over again.

Implant a metal shaft into the central void in the ceramic. The metal shaft should be tight enough to make a secure fit. Use caution against too tight of a fit, as this could cause the cap to crack and render it useless.

Insert the free end of the metal shaft into either a drill press or a lathe, with the drill press or lathe set at the lowest speed available. If speeds over 400 R.P.M. are used, the cap runs a much greater chance of shattering.

Using a diamond embedded file or saw blade, cut the tube to about 1½ times the length needed for the finished cap. Remove material from the ceramic tube until the appropriate dimensions are achieved. While removing material from the ceramic blank, frequently dip a small paintbrush into water and brush it on the ceramic to keep it cool.

Using a fine bladed saw blade or file, which is embedded with diamonds; remove the appropriate amount from the tip of the bullet until the correct length is achieved.

After removing the tip from the lathe or drill press, insert the bullet into either the lathe or drill press. Using a fine bladed file, ensure that the end of the bullet is smooth and parallel to the base of the bullet.

Dry fit the cap to the bullet to ensure that the dimensions are appropriate. The cap should be slightly under-sized in relationship to the diameter of the bullet With the cap sitting on top of the bullet, measure the overall length of the bullet/cap combination. The bullet must not exceed the maximum overall length as identified either in an ammunition reloading manual or as published on the Internet. An alternate method for assuring the correct overall length is to match the length of a bullet from the same lot as the bullet you are modifying.

If the length is correct, advance to the next step.

If the overall length is too long, remove material from the bullet tip or either end of the cap.

If the overall length is too short, apply a thin layer of either methyl 2-cyanoacrylate or ethyl-2-cyanoacrylate to the tip of the bullet. When the methyl 2-cyanoacrylate or ethyl-2-cyanoacrylate has dried, set the cap in place, and measure again. Repeat this process until the correct overall length is achieved.

Apply a fine layer of either methyl 2-cyanoacrylate or ethyl-2-cyanoacrylate to the tip of the bullet and the base of the cap allow the methyl 2-cyanoacrylate or ethyl-2-cyanoacrylate to dry. Once the glue has dried, apply a second layer of either methyl 2-cyanoacrylate or ethyl-2-cyanoacrylate to both surfaces.

Attached the cap to the bullet using tweezers to position the cap. If the methyl 2-cyanoacrylate or ethyl-2-cyanoacrylate sets before the cap is centered on the bullet, either attempt to remove the cap and try over again, or safely dispose of the bullet and cap and start over again.

As an alternate method of positioning the ceramic cap, a die may be formed from a ⅞ inch #14 bolt FIG. 41 110. Into the base of the bolt, a 12.7 mm (0.500 inch) wide hole with the sides at a 45 degree angle should be drilled FIG. 42, FIG. 43 111. Position this bolt, which has been transformed into a die, into the reloading press that has been fitted with the correct shell holder for the ammunition being modified.

Wet the ceramic cap with $H_2O$ and position the cap inside the recess 101 in the tip of the bolt. Position a shell that has been shortened into the shell holder. Close the reloading press, and then rotate the die until the ceramic cap makes contact with the bullet tip. The die should not meet with enough force to seat the bullet deeper into the cartridge.

Open the press and apply a fine drop of methyl 2-cyanoacrylate or ethyl-2-cyanoacrylate to the base of the cap and another thin layer to the top of the modified bullet.

Slowly close the mounting press and allow the cap and the bullet to be cemented together. After a minimum wait of 5 seconds, open the press and remove the bullet which now has a cap attached.

Set the modified bulled aside for 24 hours to allow the methyl 2-cyanoacrylate or ethyl-2-cyanoacrylate to completely set.

Measure the overall length of the bullet/cap combination. The bullet must not exceed the maximum overall length as identified either in an ammunition reloading manual or as published on the Internet. An alternate method for assuring the correct overall length is to match the length of a bullet from the same lot as the bullet you are modifying.

If the length is correct, advance to the next step. If the overall length is too long, lower the positioning die by no more that ¼ turn. Place the shell in the shell holder and close the press, thus forcing the bullet to seat deeper in the cartridge. Measure the cartridge overall length and repeat in the cartridge is still over length.

After the methyl 2-cyanoacrylate or ethyl-2-cyanoacrylate has set for 24 hours, insert the bullet into the drill press or lathe and spin the bullet at a slow speed. If the cap is not centered on the bullet, either remove the cap and start over again, using the diamond embedded file or saw blade attempt to remove some material from the cap until it is centered or dispose of the bullet.

The average time required to produce a single cap (not including the 24 hours required for the methyl 2-cyanoacrylate or ethyl-2-cyanoacrylate to set, is 2-4 hours.

The second method for producing capped in ammunition is to provide a set of drawings with exact dimensions to a ceramic manufacturer. The manufacturer will produce a mold for the caps to be produced by the Ceramic Injection Molding (CIM) process. This is the ceramic industries standard process for creating small precise ceramic components. This is the only precise method of producing the caps.

The Ceramic injection molding (CIM) process has extensive capabilities that provide an ideal process for the engineering of intricate features on small components.

The procedure starts with very fine ceramic powders, which are then mixed with binders using advanced techniques not available to a business not already involved in this technique. The binders form a liquid medium which carries the ceramic powders into the mold during the injection stage.

An injection molding machine is used, similar to those used for conventional plastic molding, and the molten feedstock is forced into a cavity forming a net shape part. The molds can be single- or multi-cavity configurations.

After the part is formed, it goes through two thermal processes—pyrolysis, which removes the binder, and then sintering in a high temperature kiln to form the final ceramic component.

During sintering, the component shrinks uniformly by up to 20% while retaining its complex shape.

This technique enables even highly complex components to be molded to extraordinarily tight tolerances of typically ±0.5% of the stated dimension, with exceptional process control achievable over multiple dimensional tolerances. This level of control enables the required geometry and surface finish to be achieved without the need for further processing steps, such as grinding, lapping, or polishing, which would increase both cost and lead times.

When the completed caps are delivered to you, follow the above instructions for attaching the Caps to the bullets as outlined in paragraphs 0100-0113 above.

As an alternate method of preparing the bullet tip to accept the ceramic cap, use bullets for reloading, saw off 0.21 inches from the tip, put the bullet in a lathe of drill press to ensure that the cut tip of the bullet is parallel to the base of the bullet, remove the bullet from the lathe or drill press, attach the ceramic cap to the bullet tip then treat the modified bullet as if it were a standard bullet and follow established reloading procedures.

What is claimed is:

1. A ceramic cap for a bullet, comprising:

a base configured to be attached to a distal end of the bullet with an adhesive, wherein the base provides a surface for the ceramic cap to be firmly attached to the bullet using the adhesive; and an elongated body having a first end starting at the base and a second end extended distally from the base, wherein the elongated body has a central axis extending straight between the first end and the second end of the elongated body, wherein elongated body includes:

a central raised portion that is raised from the base and inset from an edge of the base, the central raised portion having decreasing diameter along the central axis from the base to a truncated tip at the second end, wherein the central raised portion is configured to improve penetration of the bullet through glass because of its material strength and decreasing diameter; and a cavity extending along the central axis from an opening at the truncated tip through at least a portion of the central raised portion, wherein the cavity is configured to further improve penetration of the bullet through glass by providing a sharp annular edge at the truncated tip of the central raised portion.

2. The ceramic cap of claim 1, wherein the base and the elongated body are made from at least one of: a ceramic alloy, aluminum oxide, aluminum oxide with zircon, depleted uranium, or aluminum.

3. The ceramic cap of claim 1, wherein the base is configured to be firmly attached to the bullet using the adhesive comprising at least one of: methyl 2-cyanoacrylate, ethyl-2-cyanoacrylate or n-butyl cyanoacrylate.

4. The ceramic cap of claim 1, wherein the base is cooperatively shaped for pistol, revolver, rifle, or machine gun ammunition.

* * * * *